US006956953B2

(12) United States Patent
Mazarakis

(10) Patent No.: US 6,956,953 B2
(45) Date of Patent: Oct. 18, 2005

(54) ELECTROACOUSTIC TRANSDUCER WITH FIELD REPLACEABLE DIAPHRAGM CARRYING TWO INTERLACED COILS, WITHOUT MANIPULATING ANY WIRES

(76) Inventor: Anthony Mazarakis, 5 Apollo Street P Penteli, GR-152-36 Athens (GR)

( * ) Notice: Subject to any disclaimer, the term of this patent is extended or adjusted under 35 U.S.C. 154(b) by 387 days.

(21) Appl. No.: 10/049,659

(22) PCT Filed: Jun. 28, 2001

(86) PCT No.: PCT/GR01/00029

§ 371 (c)(1),
(2), (4) Date: Feb. 15, 2002

(87) PCT Pub. No.: WO02/03748

PCT Pub. Date: Jan. 10, 2002

(65) Prior Publication Data

US 2003/0002696 A1 Jan. 2, 2003

(30) Foreign Application Priority Data

Jul. 3, 2000 (GR) ..... 20000100217

(51) Int. Cl.[7] ..... H04R 25/00

(52) U.S. Cl. ..... 381/152; 381/399; 381/401; 381/427; 381/431

(58) Field of Search ..... 381/152, 407, 381/431

(56) References Cited

U.S. PATENT DOCUMENTS

| | | | | |
|---|---|---|---|---|
| 4,856,071 A | | 8/1989 | Marquiss | 381/203 |
| 5,003,609 A | | 3/1991 | Marquiss | 381/196 |
| 6,341,167 B1 | * | 1/2002 | Okuyama et al. | 381/407 |

FOREIGN PATENT DOCUMENTS

| | | |
|---|---|---|
| JP | 60204199 | 10/1985 |
| JP | 8154296 | 6/1996 |

* cited by examiner

*Primary Examiner*—Suhan Ni
(74) *Attorney, Agent, or Firm*—Wiiliam D. Hare

(57) ABSTRACT

The present invention is directed to a diaphragmatic (planar) electroacoustic transducer that forms a complete sound radiating transducer and provides high efficiency and linearity. The diaphragm is easily exchangeable and rectangular in shape, and may be made of very thin polyamide film with a plurality of aluminum conductors formed on one side of the diaphragm. The plurality of conductors form two identical and symmetrical coils such that conductors of each coil are interlaced. The two sections of the coils are disposed in dense air-gaps of the magnet system, which comprises a plurality of high (BHmax) Neodymium magnets. The binary interlaced coils can be utilized in a number of modes, for the purpose of accomplishing a variety of operating modes.

11 Claims, 5 Drawing Sheets

ELECTROACOUSTIC TRANSDUCER WITH FIELD REPLACEABLE DIAPHRAGM CARRYING TWO INTERLACED COILS, WITHOUT MANIPULATING ANY WIRES

TECHNICAL FIELD OF THE INVENTION

This invention relates to electroacoustic transducers which act as Loudspeakers and, in particular, to the thin diaphragm type of Audio transducers, which convert electrical (audio) energy into movement of a sound emitting diaphragm.

BACKGROUND OF THE INVENTION

Such transducers, which are called Planar Loudspeakers or some times Ribbon Loudspeakers, in the past years have not enjoyed the same popularity as the cone-type speakers—in spite of the superior performance of the diaphragmatic types—due primarily their high cost, and the different performance characteristics.

The conventional, cone or dome Loudspeakers are known as electromagnetic motor actuated point sound source emitting devices.

As is known to those skilled in the art of sound reproduction, the "pistonic" operation of cones or domes is not at all secured throughout their operating range, and as a result there may not be a uniform sound emitting activity from the surface of the cone or dome. Sound waves emitted from the peripheral portion of the cone or dome may be out of phase to the emitted sound, from their central part areas, at any given instant. This is an inherent distorting characteristic of cone-dome Loudspeakers, created by the mode of activation and the shape of the activated sound emitting surfaces. An additional distortion producing factor is the moving mass of cone or dome which has to be moved in accordance with the waveform of the audio current.

The demands of the audio signal can be so great in terms of moving speed and acceleration that the inertial masses or weights of the vibrating parts is a significantly limiting factor. As a result the reproduced waveform is greatly affected especially in high frequencies where the relative inertias cannot be met by the electromagnetic motor moving the heavy cones or domes.

The above severe limitations of the motor actuated Loudspeakers, such as kinetic sluggishness, shape and mass, are certainly overcome by the thin diaphragm type of loudspeaker, which employs as its sound emitting surface a diaphragm of greatly reduced mass and the moving force is applied on almost all the area of the vibrating diaphragm, thus realizing a true pistonic vibration action. The low mass of the diaphragm obeys the commands of the audio waveform with exceptional ease and the acoustic results are extreme fidelity and transparency.

Numerous types of such planar speakers can be found in use in Hi Fi systems giving very satisfactory acoustic results. Most of the planar transducers existing in commercial production today make use of a Polyester or Polyimid diaphragm which has on its surface laminated a very thin layer of parallel aluminum current carrying conductors. The diaphragm is evenly stretched over rows of magnets, the magnetic lines of which intersect the diaphragm with current currying conductors at 90°. The interaction of the magnetic lines and the magnetic field created by the current flowing through the conductors results in a force, moving the diaphragm either forward or backward in accordance with the direction—at any instant—of the flowing audio current.

Such planar loudspeakers are characterized by distinct advantages in performance over the cone-dome loudspeakers. Planar loudspeakers exhibit wider bandwidth, Linear phase response, constant impedance, greatly improved transient response and lower distortion.

All those operating advantages are the reasons of the acoustic superiority of planar loudspeakers. Because of today's digital sources of audio reproduction such as CD, DVD-Audio, SACD (Super Audio CD), DAT etc. which place higher demands on the contemporary loudspeaker systems, the above described advantages are invaluable. However all those acoustic benefits offered by planar magnetics are enjoyed by audiophiles, after paying the high cost, for the loudspeakers.

The high cost of the planar loudspeakers is acceptable to audiophiles after considering their distinct acoustic merits. The disappointment of the user may arise, however, if the delicate vibrating diaphragm happens to fail, either by mechanical failure or by thermal failure of the coil. In such situation, the remainder of the expensive structure of the planar loudspeaker is wasted as it is essentially rendered inoperative.

Invariably such planar Loudspeaker failures are not remediable by the user. Under those circumstances the magnetic structure and in fact the entire loudspeaker, for which the audiophile has paid dearly, becomes a total loss or waste. Even in the rare case of loudspeaker makers allowing return to the factory for repair, the user must again pay dearly for material, labor and transportation.

SUMMARY OF THE INVENTION

A primary object of the present invention is to provide a planar sound reproducer with excellent performance characteristics, the values of which are secured, and maintained at all times by offering the following features:

(A) The exchangeable diaphragm may carry a multiplicity of binary interlaced coils. The advantages of the binary interlaced coils, of this invention, and their applications is described below in the text.

(B) An easy and simple way of replacing the diaphragm, by the user, in the field, without the need to manipulate any wires and soldering tools in case of failure, or, in case of installing diaphragm with different characteristics.

(C) The exchangeable diaphragms in a variant of resistance—impedance characteristics.

(D) The whole surface of the binary interlaced coils being driven, in the true sense of the word driven. In order that the present invention may be more fully understood, the above statements A, B, C, D will be elaborated and with the help of accompanying drawings fully elucidated.

In the present invention the replacement of the diaphragm is accomplished by the user in a very simple operation, without the need of manipulating wires or using a soldering or de-soldering means, as is necessary in prior art equipment.

In the prior art, the diaphragm of commercial planar speakers employ for driving, single coil, in contrast, with the present invention which provides two (binary) interlaced coil, for simultaneous driving. In the present invention, in addition to the easy field replacement, the diaphragm is characterized by two symmetrical coils configuration, which are interlaced, in a manner of being the one into each other, thus occupying the same area of the said diaphragm and securing the fact that the two coils are absolutely identical with all electrical characteristics such as Resistance, Impedance, Inductance being absolutely equal. Such Binary Interlaced Coils can be laid, in a multiplicity of similar B.I.C. executions, on the same long diaphragm tensioning adjustment means, for obtaining desired low frequency operation. A long and slim loudspeaker embodying in its diaphragm a multiplicity of binary interlace coils, can lead to the design of full range hybrid speaker driver, with line source behavior. The two coils in the present invention are characterized by symmetricity and equality of their parameters, a condition which permit the creation of several combinations of impedance networks, which can act as the output loads of an amplifier.

DETAILED DESCRIPTION OF THE INVENTION

It is an objective of the present invention to provide to those skilled in the art of sound reproduction, the flexibility of connecting, in series the two coils for maximum sensitivity or in parallel for increased power capability. Additional connecting possibilities of the two coils are as follows:

| Two terminal networks | Four terminal networks |
|---|---|
| Single coil operation | Two winding transformer |
| Double coil series operation | Two winding auto transformer |
| Double coil parallel operation | Two winding push-pull configuration |

In addition, the invention of binary symmetrical interlaced coils configuration can inspire and provide the means, to those skilled and wishing, to devise new applications such as:

A) DDL. Direct Digital Loudspeaker circuitry

B) Feedback optimizer circuitry

C) Magnetic damping circuitry

D) Crossover at two different frequencies

E) Push-Pull circuitry

F) Long line source loudspeakers

G) Other inventive applications

An other object of the present invention is the character of the exchangeable diaphragm assembly and the way the totality of the coils conductors are energized by the magnetic field.

Specifically, the semicircular sections of the interlaced coils, which are at the two ends of the longitudinal axis of the diaphragm are not clamped, but free to move, and in addition the semicircular section of the conductors are intersected by the magnetic flux lines exactly as the linear section of the conductors.

Thus effectively driving the semicircular sections, in strict accordance with the excursions of the linear sections, therefore the entire area of the coils is moving in a true pistonic action.

The Ampère's Law for the force on a conductor, it asserts that any conductor of (L) length carrying a current (i) and located in a magnetic field (B) at right angle to the flux lines, will be pushed by a force (F) that is proportional to the flux density, to the current and to the length of the conductor. The above principle is mathematically expressed as: F=BLi, F, B, i being vector quantities. This is the principle that governs the force which moves the diaphragms of all planar speakers.

In applying Ampère's Law, it should be noted that for any length (L) of conductor the directions F, B and i are mutually perpendicular.

Figure 5:
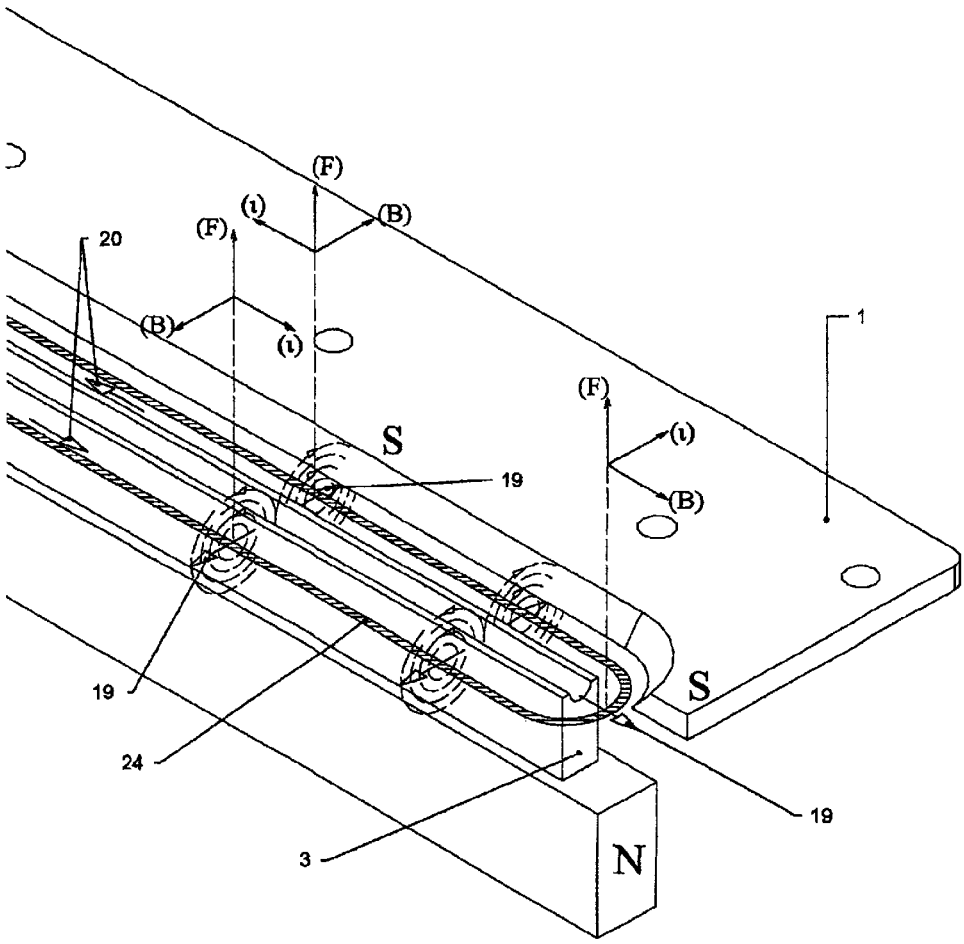
FIG. 5 illustrates the application of the Ampere's Law in the length (L) of the present invention's diaphragm conductors.

FIG. (5) shows these directions along the three geometric axes, as the Law is examined in three points along a typical turn of our diaphragm, where is confirmed that the Force (F) has the same direction in the linear and the semicircular section of the conductor, thus the semicircular section is actively contributing in the sound emitting activity By using FIG. 5 it is clearly shown that the Ampère's Law is applied in all the length (L) of our diaphragms conductors.

The various diaphragmatic loudspeakers of prior art invariably have the extreme sections of their elongated coils, not actively participating in the force producing process, and in some cases they are clamped and immovable.

Figure 3:
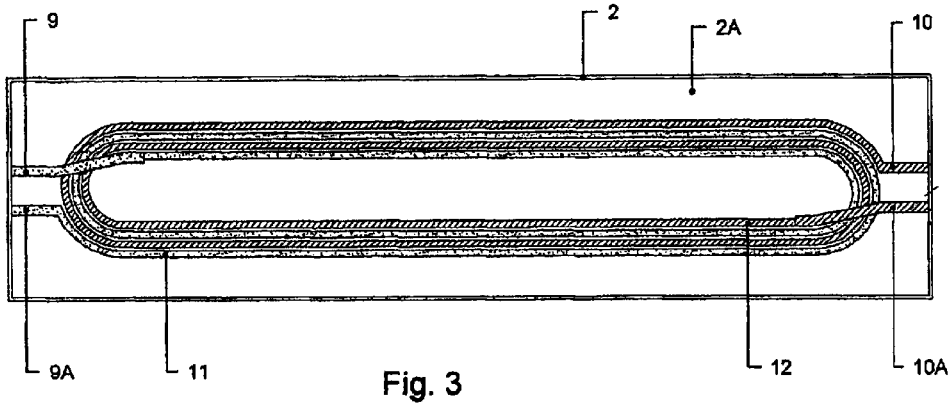
FIG. 3 is an illustration showing the two pairs of contact islands and that correspond t the two interlaced coils.

With reference to a U.S. Pat. No. 5,003,610 titled:

"Whole surface driven speaker" assigned to Fostex corporation, Japan, the following comments should be made:

The claim of the title that the entire surface is "driven" does not seem correct, because there are sections of diaphragm coil extremities which actually are not driven and are not force producing sections, Those sections, FIG. 3 of the U.S. Pat. No. 5,003,610 are simply carried out by the rest of the active linear sections, which are force producing, obeying the Law F=BLi.

Figure 1:
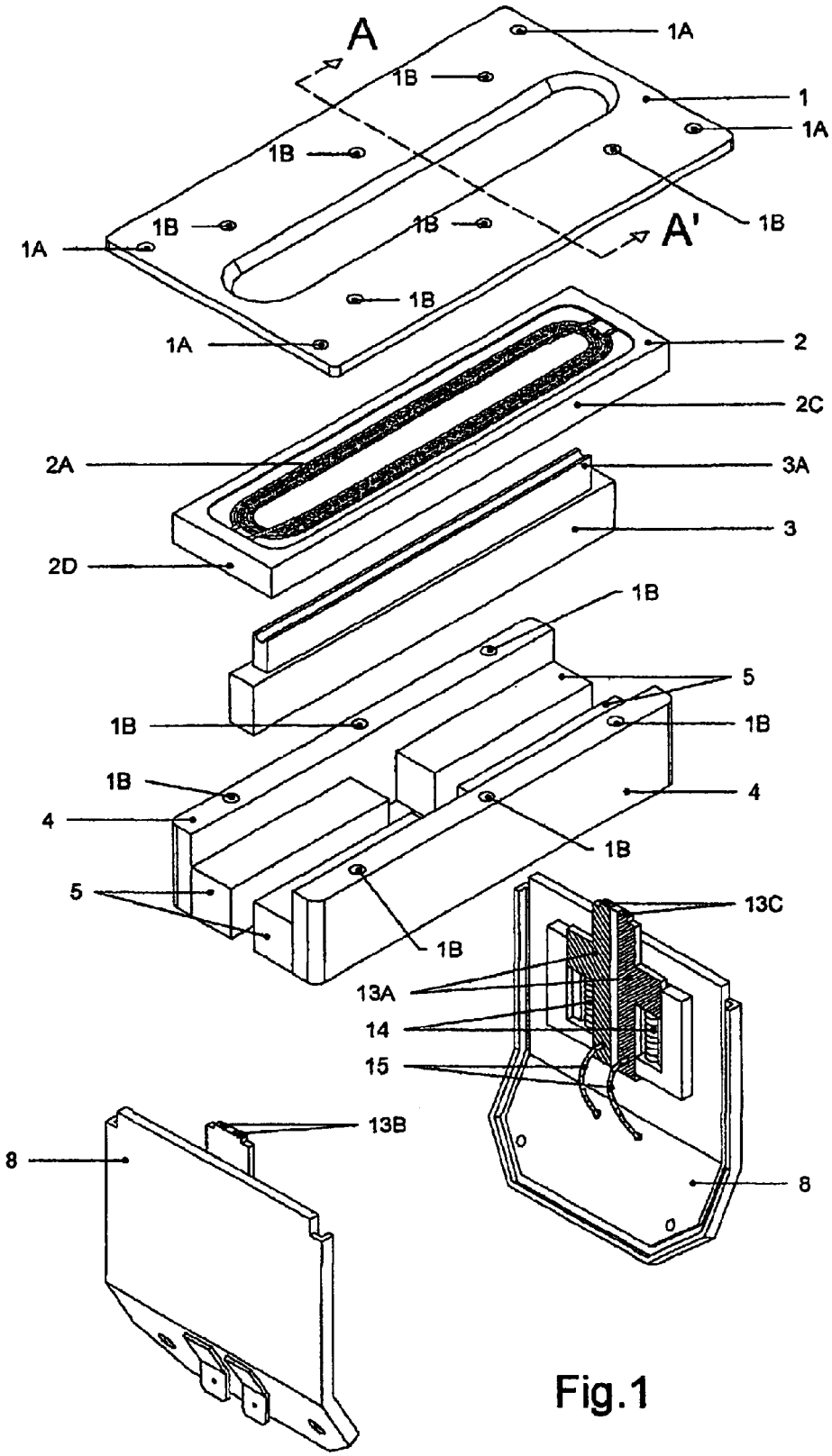
FIG. 1 is an illustration of the main components of the diaphragmatic electroacoustic transducer
Figure 2:
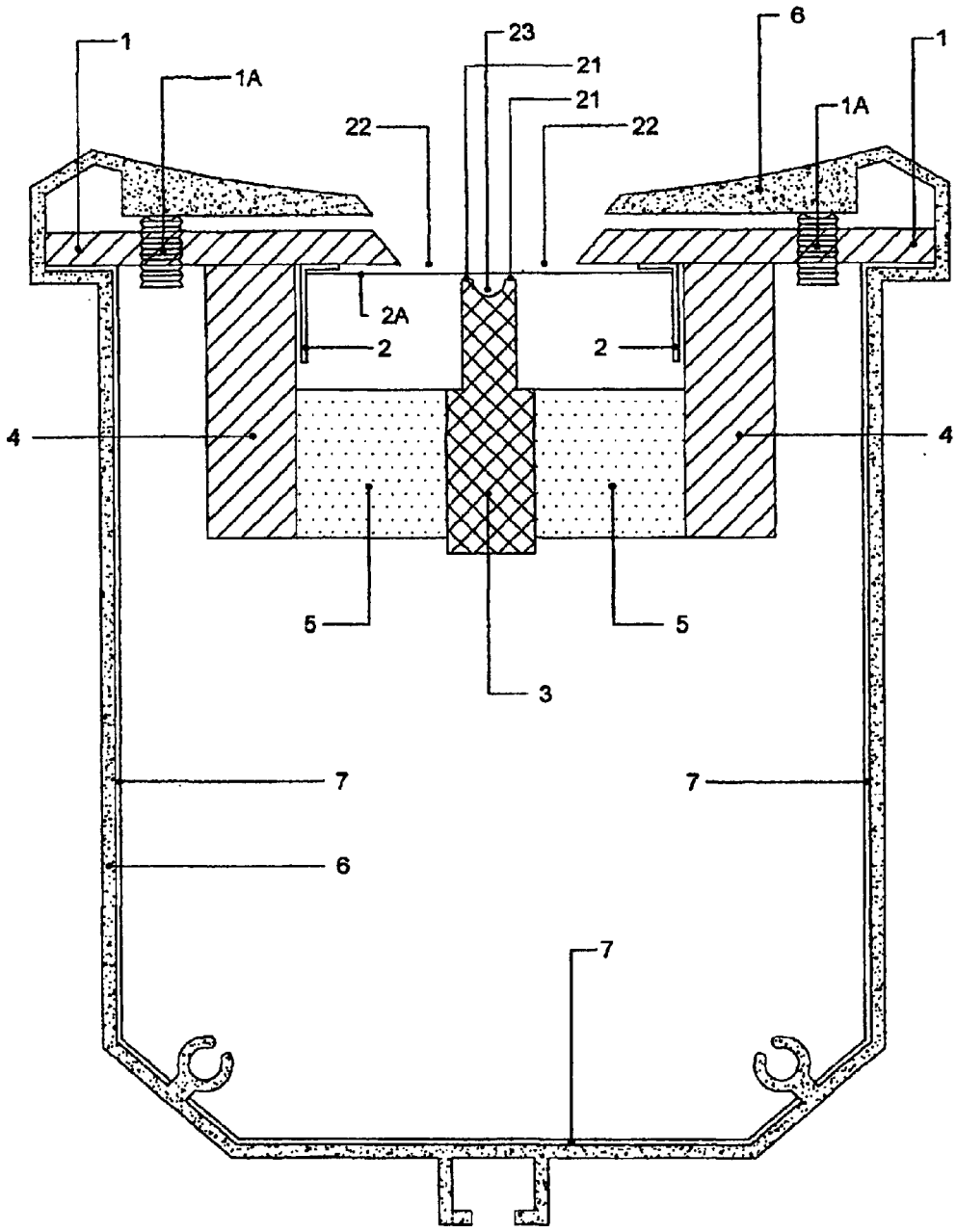
FIG. 2 is a cross-sectional view that shows the upper plate pole, the diaphragm assembly, the central pole, the side poles, the Neodymium magnets with the two air gaps the upper plate pole and the central pole 3.
Figure 2B:
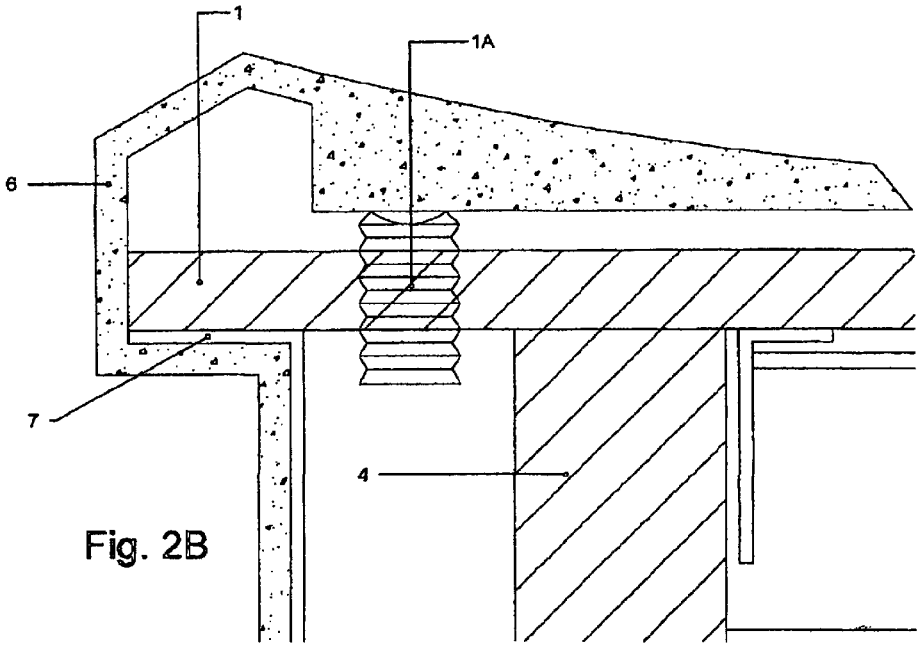
FIG. 2B is a cross-sectional view showing the headless screws against the internal surface of the front part of the aluminum enclosure.
Figure 2A:
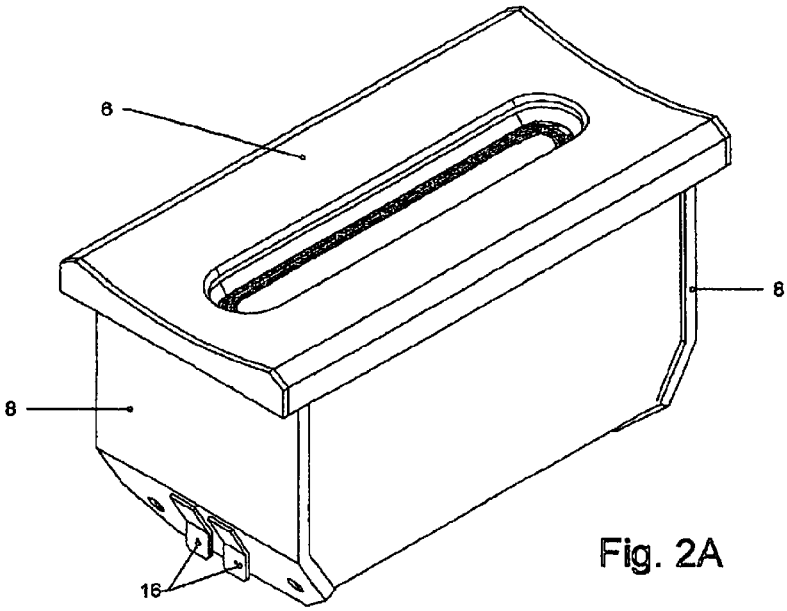
FIG. 2A is a perspective view of the complete loudspeaker assembled and the two covers being in place.

With reference to drawings and more particularly to FIG. 1, is shown all the main components; which compose the present invention and which are: the upper plate pole 1, the diaphragm assembly 2, the central pole 3, the side poles 4, the Neodymium magnets 5, which are required for the construction of diaphragmatic electroacoustic transducer in accordance with the present invention. The members 1, 3, 4 are made of low carbon soft iron material FIG. 2 shows the components 1, 2, 3, 4, 5, assembled and the created two air gaps 22, between upper plate pole 1, and the central pole 3. FIG. 2 shows the complete transducer assembly installed in its aluminium enclosure 6, as indicated in Line A–A' cut of FIG. 1, FIG. 2A shows in perspective view, the complete loudspeaker assembled and the two covers 8 being in place, thus realizing the contact of each coil of the diaphragm, with the respective terminals 16 outside of each plastic cover 8.

In FIG. 1 the upper plate 1 is machined in highly polished surfaces for low magnetic losses when attached by six screws 1B to side poles 4. Following this attachment of 1 to 4, the Neodymium magnets 5 together with the central pole 3, are put in place, with appropriate adhesive agent. This assembly procedure always takes care that the upper plate 1 is the South pole of the magnets and the central pole 3 is the North pole. By convention we consider that the direction of magnetic flux lines have a direction from N- to -S as indicated in the analysis of FIG. 5.

By referring to FIG. 2, and in particular to the groove 23 of the upper part of the central pole 3, it should be given the two reasons of the groove 23. At first the flux lines traversing the air gap 22, are mostly departing from the two banks 21, of the groove 23 and, very few lines departing from the bed 23 of the groove. If the groove geometry is examined in conjunction with geometry of the two interlaced coils will be apparent that the central section of the diaphragm 2A, is not covered by coil conductors and therefore any lines intersecting that section are a waste. Also any lines reduced from departing the inner part of the groove 23 of the central pole 3, are added to the useful part of flux lines departing from the groove banks 21. An additional usefulness of the groove is the filling of the bed by a soft wool thread, which is "overflowing" the bed, and thus at extreme excursions of the diaphragm, the wool thread acts as acoustic bumper.

By referring FIG. 1 to the pieces 1, 3, 4 and 5 assembled, the magnetic system is ready to accept the exchangeable diaphragm assembly 2. The diaphragm assembly 2 is inserted in its operating position by holding the frame from the side 2D and sliding the long sides 2C between the poles 4 and the short side 2B with the opening, better showing in FIG. 4, allowing the passage, without the thin part 3A of the central pole 3 being an obstacle.

Referring FIG. 1 the magnetic assembly, which comprises an upper plate pole 1, a center pole 3 the side poles 4, the Neodymium magnets 5, can now be inserted in the aluminium enclosure 6 and fixed in place by four hexagon headless screws 1A threaded on the upper pole 1. As shown in FIG. 2B, by screwing each 1A against the internal surface of the front part of the aluminium enclosure 6, the upper pole 1 squeezes a ferrous metal sheet 7 which acts as magnetic shielding and at the same time it immobilizes the magnetic assembly inside the aluminium enclosure, by anchoring it in four different points 1A×4, as per FIG. 1, FIG. 2A.

Figure 4:
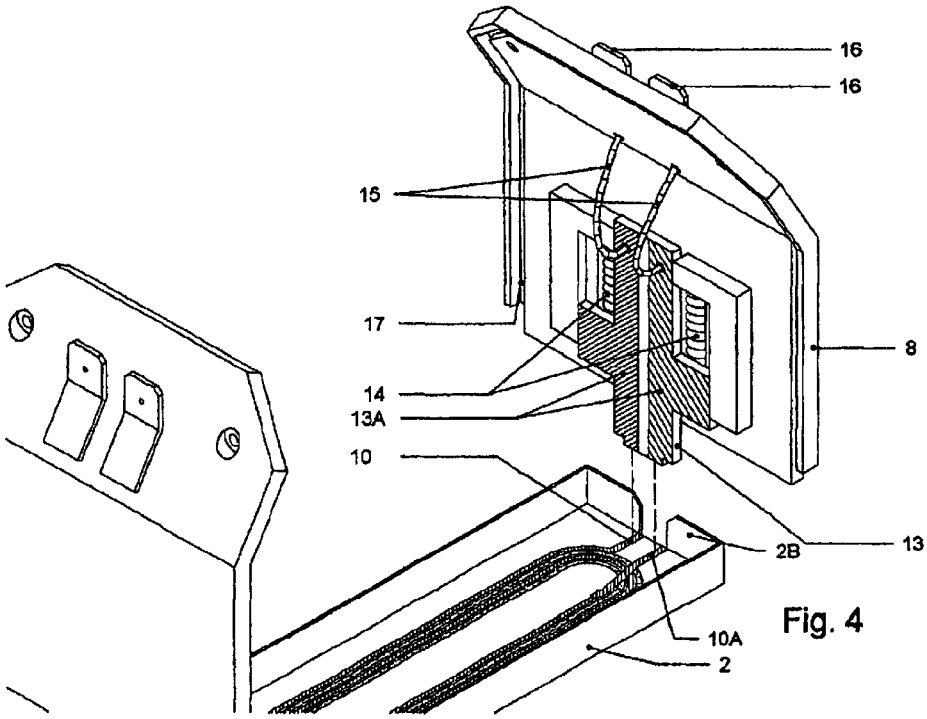
FIG. 4 is a perspective illustration showing the open loudspeaker with the diaphragm assembly inserted in its operating position.

With the magnetic assembly inside the enclosure 6 and fixed, the diaphragm assembly 2 shown in FIG. 3 and FIG. 4 is in its operating place FIG. 4, ready to accept the spring loaded contacts 13, 13C which are better shown on FIG. 1 and realize their electrical access from the outside contacts 16. In FIG. 3 are shown the two pairs of contact islands 9, 9A and 10, 10A corresponding to the two interlaced coils 11 and 12 respectively.

In order to understand the automatic contacting of the external terminals 16 with the two coils 11 and 12 of the exchangeable diaphragm 2 as shown in FIG. 4, is necessary to review the functioning of the transducer covers 8. Both covers are identical plastic pieces and are airtightly closing the inside of the loudspeaker. This is accomplished by providing a soft gasket material which is placed at the bottom of guiding groove 17. The guiding groove 17 is playing another role, which is riding on the edge of the aluminium enclosure during the closing operation, guides the cover to its final closing position, at which should be precisely making the electrical contact operation. The inside of each cover is characterized by the two spring 14, the spring loaded contact carrier 13 which is cross shaped and which is a copper clad material, as that used in printed circuit boards, of 2 mm thickness.

The contact carrier 13 is separated in two contacting copper areas 13A along its longitudinal dimension, on the one side having soldered the pair of gold plated contacts 13B, 13C, FIG. 1 and on the other side are attached by soldering, one pair of flexible conductors 15, the free ends of which are soldered on the inside riveting member of the terminals 16, supported on the outside of the cover plastic cover 8.

FIG. 4 shows by dashed lines the path or routing of the spring loaded contacts and the eventual contact with contact islands 10, 10A, which takes place at the end of the transducer covering operation. The spring compression of both covers, applied on each extremity of the diaphragm assembly 2, through the contact islands 9, 9A and 10, 10A besides the electrical contact making action, they hold firmly the diaphragm assembly 2 to its proper operating position. This position bring the two coils at 0.6 mm below the lower surface of upper plate 1 and 0.6 mm above the two banks 21 of the central pole 3. With the help of FIG. 5 and the Amp ers law we shall expose the electromagnetic force F which is exerted on typical conductor turn of our coil, and prove that every part of the coil, linear and semicircular, is driven by a unidirectional force at any instant and that the whole coil surface is driven in strict accordance with the driving audio signal. The force F in dynes which drives the conductors of the two interlaced coils, is expressed in mathematical terms as: F=BLi, where

*B*=Flux density of magnetic lines in Kilo–Gauss, arrows 19 indicate the direction of flux lines L=the length of the conductors in Meters i=the current in the coil in Amp ers arrows 20 indicate the direction of current in the conductor F=the force in dynes resulting from the interaction of B and i arrows. F indicates the direction of the force The quantities F, B, i are vectors and according to Amber Law are mutually perpendicular. FIG. 5 shows the three vectors F, B, i along the three geometric axes, applied in points along the linear sections of the coil 24 as well as the semicircular sections of the coil 24, where the perpendicularity of B and the direction of i is applied on the tangent on the application point.

It is clearly shown that with vectors B and i unchanged in direction, at any instant, the resulting force vector F, as applied in three different points on a coil's conductor turn, is of the same direction.

It is therefore clear that the whole surface which is covered by the two interlaced coils are moving by force F in exact accordance with the audio signal, pistonically.

BRIEF EXPLANATION OF THE DRAWINGS

FIG. 1 An exploded view illustrating the components of the Planar Loudspeaker at its first embodiment of the Present invention.

FIG. 2 Sectional view taken through cut line A–A' of FIG. 1 with the Planar loudspeaker components, being in the assembled Position, and installed in the aluminum enclosure.

FIG. 2A Perspective view of the complete planar loudspeaker assembled in the aluminum enclosure and the two covers in position.

FIG. 2B A fragmentary enlarged view of upper plate and aluminum enclosure showing the way of fixing in place the complete transducer inside the aluminum enclosure FIG. 3 Top view of the exchangeable diaphragm assembly, showing the second embodiment of the present inventions the binary interlaced coils 1 and 2.

FIG. 4 Perspective view of a third embodiment showing the contact island and the spring loaded mating contacts approaching.

FIG. 5 A fragmentary enlarged view of a portion of the diaphragm's conductor, being exposed in the influence of magnetic Field in the air gap and the unidirectional forces, acting to all portions of the coil

What is claimed is:

1. A thin diaphragm electroacoustic transducer having at least two elongated interlaced coils for use as loudspeaker, characterized by including a field replaceable sound emitting diaphragm that can be replaced without needing to manipulate wires, the electroacoustic transducer comprising:

a) a magnetic system comprising an upper plate pole, two side poles, a central pole and a row of Neodymium magnet bars, wherein two air gaps are formed between the upper plate pole and the central pole and magnetic lines transversing the gap create a high density field;

b) a thin foil diaphragm carrying at least two thin aluminum conductors forming at least one binary interlaced coil, the two thin aluminum conductors being built the one into each other, and being situated substantially in the plane of the magnetic lines transversing the air gaps, wherein the conductors of the diaphragm, when crossed by the same intensity of flux lines perpendicularly, at the totality of their length, are subject to the same force F upon the application of F=Bli; and c) a diaphragm sound emitting assembly comprising a frame made of non-ferrous sheet metal, on which is tensioned a vibratable thin diaphragm comprising a high temperature polymer on which are formed two elongated coils of aluminum foil, the elongated coils being identical, symmetrical, and interlaced the one into the other.

2. The thin diaphragm electroacoustic transducer as claimed in claim 1, wherein the diaphragm comprises a double coil configuration, is adhered along the periphery of the frame, and the elongated conductors of the two coils are terminated in two aluminium foil conducting islands, each of which are symmetrically located at extremities of the diaphragm assembly.

3. The thin diaphragm electroacoustic transducer as claimed in claim 2, wherein the conducting islands, when the diaphragm assembly is properly inserted inside the transducer, are situated in a sliding routing or path of a pair of contacts which are spring loaded, and supported on a pair of sliding covers, whereby at the end of the sliding route of each cover, two spring loaded contacts are pressed against the two conducting islands.

4. The thin diaphragm electroacoustic transducer as claimed in claim 3, wherein the spring loaded contacts are gold plated at their tip and soldered on the sliding cross shaped contact carrier, the contact carrier being made of copper laminated Bakelite sheet.

5. The thin diaphragm electroacoustic transducer as claimed in claim 4, wherein the copper laminated sheet is separated in two conducting surfaces, and one contact is placed on each contact, the one end of the cross, shaped contact carrier 13, are soldered two flexible conductors of which their other end are soldered on the riveting member of the loudspeaker terminal.

6. The thin diaphragm electroacoustic transducer as claimed in claim 5, wherein when the diaphragm assembly is replaced by removing the two transducer covers, the diaphragm assembly is free to be withdrawn.

7. The thin diaphragm electroacoustic transducer as claimed in claim 6, wherein when the new diaphragm is inserted, the connecting of the two coils with the corresponding terminals is accomplished by reclosing the transducer's upper and lower covers, whereby the reclosing action terminates the one coil on the upper terminals and the other coil on the lower terminals.

8. The thin diaphragm electroacoustic transducer as claimed in claim 7, wherein two semicircular sections of the coils are free to vibrate, an audio current flowing in the semicircular section of each coil is actively contributing in the sound producing process in the same procedure as the linear sections of the coil, thereby increasing the transducer efficiency.

9. The thin diaphragm electroacoustic transducer as claimed in claim 8, wherein a central pole profile cut has a shape comprising two outer edges bounding an inner region and reduces the number of useful magnetic lines crossing the center part of the diaphragm which is empty of conductors and one or more reduced lines emanating from the inner region are added to those crossing an active gap area and crossing the coils' conductors.

10. The thin diaphragm electroacoustic transducer as claimed in claim 9, wherein a shape of the central pole, where its upper part groove is configured to accept an elongated soft material that overflows the groove which acts as bumper for the diaphragm during high amplitude excursions.

11. The thin diaphragm electroacoustic transducer as claimed in claim 1, wherein the interlaced coils of its diaphragm can be utilized in one or more modes, the one or modes comprising a) In series connection for increased sensitivity, b) in parallel connection for increased electrical power handling ability, c) for as a crossover in two different frequencies, d) as a DDL Direct Digital Loudspeaker, e) as a feedback optimizer circuitry, f) as a magnetic damping circuitry, and h) in a two winding push-pull configuration.

* * * * *